United States Patent [19]

Nakamura et al.

[11] 4,350,619

[45] Sep. 21, 1982

[54] GRANULAR DETERGENT CONTAINING ZEOLITE, SILICATE, LAS AND OLEFIN SULFONATE

[75] Inventors: Masayoshi Nakamura, Chiba; Teruo Magari, Funabashi; Seiji Abe, Kokubunji; Mitsuyoshi Yazaki, Chiba, all of Japan

[73] Assignee: Lion Corporation, Tokyo, Japan

[21] Appl. No.: 256,157

[22] Filed: Apr. 21, 1981

[30] Foreign Application Priority Data

Apr. 23, 1980 [JP] Japan ..... 55-54627

[51] Int. Cl.[3] ..... C11D 1/14; C11D 1/22; C11D 3/12; C11D 11/02

[52] U.S. Cl. ..... 252/537; 252/135; 252/140; 252/174; 252/174.25; 252/179; 252/536; 252/555; 252/556

[58] Field of Search ..... 252/135, 140, 179, 174.25, 252/536, 537, 555, 556, 174

[56] References Cited

U.S. PATENT DOCUMENTS

| | | | |
|---|---|---|---|
| 3,932,316 | 1/1976 | Sagel | 252/532 |
| 3,985,669 | 10/1976 | Krummel | 252/116 |
| 4,019,999 | 4/1977 | Ohren | 252/140 |
| 4,129,511 | 12/1978 | Ogoshi | 252/140 |
| 4,180,485 | 12/1979 | Llenado | 252/532 |
| 4,243,545 | 1/1981 | Campbell | 252/140 |
| 4,287,101 | 9/1981 | Nishio | 252/537 |

*Primary Examiner*—Dennis L. Albrecht

*Attorney, Agent, or Firm*—Armstrong, Nikaido, Marmelstein & Kubovcik

[57] ABSTRACT

Non-phosphate laundry detergents in granular form having good detergency, good granular strength and little tendency to deposit zeolite on fabrics are obtained by using a combination of olefin sulfonate, linear alkylbenzene sulfonate, sodium silicate and type A zeolite detergent builder.

4 Claims, 1 Drawing Figure

GRANULAR DETERGENT CONTAINING ZEOLITE, SILICATE, LAS AND OLEFIN SULFONATE

BACKGROUND OF THE INVENTION (1) Field of the Invention

The present invention relates to a zeolite-containing non phosphate granular detergent composition, suitable for use in washing fabrics or clothes, which has both good detergency and powder properties, neverthless no phosphate which functions as a detergent builder is contained in the composition.

(2) Description of the Prior Art

Conventional granular detergent compositions heretofore used domestically, as laundry detergents, in washing fabrics or clothes mainly contain, as a detergent builder, condensed phosphates such as tripolyphosphates, pyrophosphates and the like. However, it is well-known that the use of phosphates tends to be restricted from the point of view of the protection of the natural environment which is adversely affected by the phosphates. In view of these recent trends, various new detergent builders which can be substituted for the phosphates have been proposed in the art. Of these proposed detergent builders, type A zeolites (alumino silicates) are remarkably noted as a new builder which can be substituted for conventional phosphates, since the type A zeolites have a high capacity to capture a calcium ion or a mangesium ion in hard water and also have a good builder effect on detergency (or detergent power) (see British Patent Specification Nos. 1473201, 1473202 and 1429143).

However, the type A zeolites (which are simply referred to as "zeolites" hereinbelow), different from the phosphates, are water-insoluble. Therefore, when soiled or stained articles are washed with granular detergent compositions containing zeolites, the deposit of the zeolites is adhered to the articles to be washed (i.e. deposits on fabrics or clothes). Especially, when colored articles are washed, there is a problem that the deposits appear as outstanding undesirable white spots. It is known that the deposits of zeolites on fabrics or clothes are especially remarkable when the zeolites are used together with sodium silicate.

In order to reduce the deposits on fabrics or clothes, various methods have been proposed. For instance: (i) the amount of the sodium silicate incorporated into a detergent composition is decreased to 3% or less, as disclosed in U.S. Pat. No. 3,985,669; (ii) the molar ratio of $Na_2O/SiO_2$ in the sodium silicate is increased and also a polyvalent carboxylate is incorporated into a detergent composition, as disclosed in U.S. Pat. No. 4,180,485: and (iii) the chance of the contact of the zeolites with sodium silicate in the production steps of the granular detergent compositions lessens as much as possible, as disclosed in British Patent Specification No. 2013707. These methods can reduce to some extent, the deposits of the zeolites on fabrics or clothes. However, there are other problems in these methods that the powder properties of the granular detergent compositions cannot satisfy and/or the production steps of the granular detergent compositions are troublesome.

SUMMARY OF THE INVENTION

An object of the present invention is to obviate the abovementioned problems of the conventional zeolite-containing non phosphate granular detergent compositions and to provide a zeolite-containing non phosphate granular detergent composition having improved properties in detergency, good powder properties, and almost no deposits of zeolites on fabrics or clothes.

Other objects and advantages of the present invention will be apparent from the description set forth hereinbelow.

In accordance with the present invention, there is provided a zeolite-containing non phosphate granular detergent composition comprising (a) at least one α-olefin sulfonate (which is sometimes referred to as "AOS" hereinbelow) having 14 to 20 carbon atoms, (b) at least one linear alkylbenzene sulfonate (which is sometimes referred to as "LAS" hereinbelow) having 10 to 14 carbon atoms in the alkyl group thereof, (c) at least one sodium silicate having the general formula of $Na_2O.nSiO_2$, wherein n is a number of from 2.0 to 2.6, and (d) at least one type A zeolite, the total amount of the components (a) and (b) being 20 to 25% by weight of the total amount of the composition, the amount of the component (d) being 10 to 20% by weight of the total amount of the composition and the weight ratio of the components (a), (b) and (c) being within the area enclosed by the points A [(a):(b):(c)=64:21:15], B [(a):(b):(c)=45:15:40], C [(a):(b):(c)=12:48:40] and D [(a):(b):(c)=17:68:15] defined in the accompanying triangular diagram.

BRIEF DESCRIPTION OF THE FIGURE

The present invention will be better understood from the description set forth below with reference to the accompanying drawing of FIG. 1, which is a triangular diagram illustrating the composition of (a) an α-olefin sulfonate having 14 to 20 carbon atoms, (b) a linear alkylbenzene sulfonate having 10 to 14 carbon atoms in the alkyl group thereof and (c) a sodium silicate having a general formula of $Na_2O.nSiO_2$ (n=2.0–2.6).

DESCRIPTION OF THE INVENTION

Figure 1:
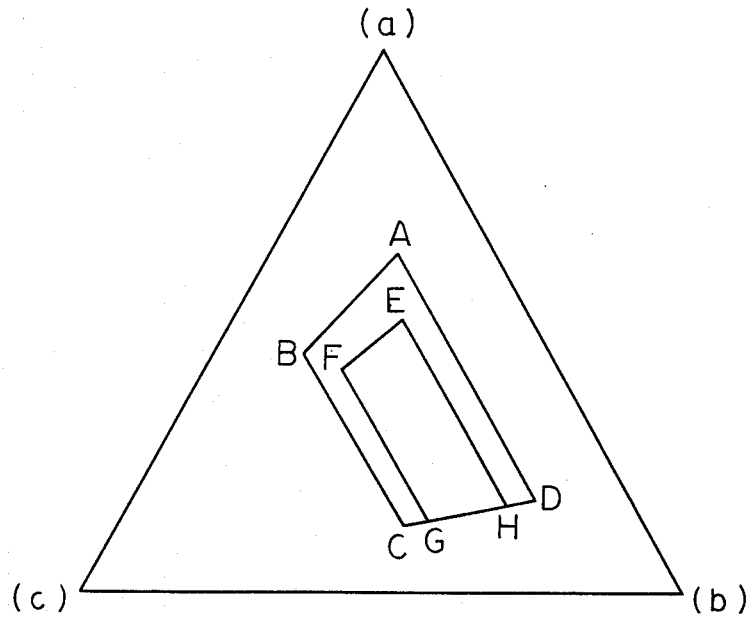

The α-olefin sulfonates used as the component (a) in the present invention include those having 14 to 20 carbon atoms, which can be prepared in any conventional manner. For instance, α-olefins (including vinylidene type olefin) having 14 to 20 carbon atoms on average, which are prepared by wax cracking processes, ethylene oligomerization process utilizing Ziegler catalysts or improved processes thereof, are first sulfonated by gaseous sulfur trioxide diluted with an inert gas, and the sulfonated products are then neutralized with, for example, alkali metal hydroxides, followed by being hydrolyzed. Thus, the desired α-olefin sulfonates are prepared. Typical examples of the α-olefin sulfonates are alkali metal (e.g. Na, K), alkaline earth metal (e.g. Ca, Mg), ammonium and alkanol amine salts, of α-olefin sulfonic acids such as 1-tetradecene sulfonic acid, 1-hexadecene sulfonic acid, 1-octadecene sulfonic acid and the like. These α-olefin sulfonates can be used alone or in any mixture thereof.

The linear alkylbenzene sulfonates used as the component (b) in the present invention are those having 10 to 14 carbon atoms in the alkyl group thereof, which can be prepared, for example, by sulfonating alkylbenzenes having 10 to 14 carbon atoms in the alkyl group thereof with sulfuric anhydride or chlorosulfonic acid, followed by the neutralization with, for example, alkali metal hydroxides. Typical examples of the linear alkylbenzene sulfonates are alkali metal (e.g. Na, K), alkaline earth metal (e.g. Ca, Mg), ammonium and alkanol amine salts, of alkylbenzene sulfonic acids such as decylbenzene sulfonic acid, dodecylbenzen sulfonic acid, tridecylbenzene sulfonic acid, tetrabenzene sulfonic acid and the like. These linear alkylbenzene sulfonates can be used alone or in any mixture thereof.

As mentioned hereinabove, the total amount of the components (a) and (b), which are used as active components, must be within the range of from 20 to 25% by weight of the total amount of the composition. In the case where the total amount of the components (a) and (b) is less than 20% by weight, the detergency of the resultant detergent composition becomes poor. Contrary to this, in the case where the total amount of the components (a) and (b) is more than 25% by weight, the viscosity of the slurry from which the desired granular detergent composition is formed becomes high, so that the granulation of the detergent composition is difficult.

The sodium silicates used as the component (c) in the present invention have the general formula of $Na_2O.nSiO_2$, wherein n is a number of from 2.0 to 2.6. In the case where the number n is less than 2.0, the particle strength of the resultant granular detergent composition is undesirably decreased. Contrary to this, in the case where the number n is more than 2.6, the amount of the zeolite deposits on fabrics or clothes is undesirably increased. These sodium silicates having the number n with a value of 2.0 to 2.6 in the above-mentioned general formula are commercially available. These sodium silicates can be used alone or in any mixture thereof.

The zeolites used as the component (d) in the present invention are type A zeolites which can be prepared by reacting sodium silicate or silica with sodium aluminate in the presence of alkalis, followed by the crystallization of the reaction products. The zeolites can be represented by the general formula of $Na_{12}.[Al_{12}.Si_{12}.O_{48}].27H_2O$. The zeolites used in the present invention may contain as impurities sodalites, type X zeolites, type Y zeolites and amorphous zeolites. The type A zeolites, preferably having a particle size of 10 microns or less, more preferably 5 microns or less, must be incorporated into the desired granular detergent composition in an amount, as anhydride, of 10 to 20% by weight of the total amount of the composition. In the case where the amount of the type A zeolites is less than 10% by weight of the total amount of the composition, the detergency of the composition becomes poor. Contrary to this, in the case where the amount of the type A zeolites is more than 20% by weight of the total amount of the composition, the viscosity of the detergent composition slurry becomes high, so that the particles sizes of the granular detergent composition obtained from, for example, the spray drying of the slurry are not uniform and, therefore, the particle strength of the granular detergent composition is undesirably decreased and the amount of the zeolite deposits on fabrics or clothes is undesirably increased.

Furthermore, the weight ratio of the above-mentioned components (a), (b) and (c) of the granular detergent composition according to the present invention must be within the area specified in the triangular diagram of FIG. 1. That is, the weight ratio of the components (a), (b) and (c) must be within the area enclosed by the points A [(a):(b):(c)=64:21:15], B [(a):(b):(c)=45:15:40], C [(a):(b):(c)=12:48:40] and D [(a):(b):(c)=17:68:15] defined in the accompanying triangular diagram, and more preferably within the area enclosed by the points E [(a):(b):(c)=52:28:20], F [(a):(b):(c)=42:23:35], G [(a):(b):(c)=13:52:35] and H [(a):(b):(c)=16:64:20] defined in the accompanying triangular diagram. In the case where the weight ratio of the components (a), (b) and (c) are not within the area enclosed by the points A, B, C and D, the desired granular detergent composition having satisfactory characteristics in the detergency, almost no zeolite deposits on fabrics or clothes and the powder properties (especially the particle strength) of the granular detergent composition cannot be obtained.

As mentioned hereinabove, according to the present invention, the zeolite-containing non phosphate detergent composition having desired detergency, almost no deposits of zeolites on fabrics or clothes and good powder properties can be obtained by selecting, as an active component, the specified mixture of the α-olefin sulfonate (AOS) and the linear alkylbenzene sulfonate (LAS) and using AOS, LAS and the sodium silicate (Sil) in the specified ratio.

In addition to the above-mentioned components (a), (b), (c) and (d), the present granular detergent composition including no phosphates can optionally contain any conventional detergent ingredients in an amount of less than 50% by weight of the total amount of the composition. Typical Examples of the detergent ingredients are as follows.

(I) Other surface active agents such as nonionic surface active agents, for example, polyoxyethylene alkyl ethers, polyoxyethylene alkylphenol ethers, polyoxyethylene fatty acid esters, sorbitan fatty acid ester polyoxyethylene ethers, sucrose fatty acid esters, fatty acid alkylolamides and the like and ampholytic surface active agents, for example, betaine type active agents (e.g. lauryl dimethyl carboxymethyl ammonium betaine), alanine type active agents (e.g. N-cocoil-N-methyl-β-alanine natrium), imidazoline type active agents (e.g. 2-lauryl-N-carboxymethyl N-hydroxyethyl imidazolium betaine) and the like.

(II) Organic builders such as citrates, malates, tartarates, maleate polymers, alkyl-substituted succinates, oxydiacetates and the like.

(III) Other ingredients such as water-soluble sulfates, water-soluble carbonates, antiredeposition agents (e.g. CMC, PVA), foam controlling agents, fluorescent brightener, bleaching agents, colouring agents, perfumes and the like.

EXAMPLE

The present invention will now be further illustrated by, but is by no means limited to, the following Examples.

EXAMPLES

The zeolite-containing non phosphate granular detergent compositions having the compositions shown in the upper portions of Table 1 below were prepared by using a conventional spray drying process. The deposits of zeolite on fabrics or clothes, the particle strength and the detergency (i.e. detergent power) of the granular detergent compositions thus prepared were evaluated according to the following procedures. The results are shown in Table 1 below.

EVALUATION OF DEPOSIT OF ZEOLITE ON FABRICS OR CLOTHES

A sample of a granular detergent composition was packed into a carton for detergent having a size of 22 cm×15.5 cm×5.5 cm and a water vapor transmission of 300 g/m$^2$.24 hr and allowed to stand for 3 days in a humidity box under the conditions of a temperature of 35° C. and a relative humidity of 100%. Thereafter, dark colored shirts, socks and towels were washed for 10 minutes in a jet-type electric washer by using the granular detergent composition in the carton under the conditions of a detergent concentration of 0.133% by weight, a liquid volume (city water) of 30 liters, a bath ratio of 30 and a liquid temperature of 25° C. After washing, the washed articles were rinsed twice, 3 minutes each time under the above-mentioned washing conditions except that no detergent composition was contained in rinsing water. After rinsing, the rinsed articles were air dried and the deposits on the dried articles were brushed off on to a black paper.

The deposition on fabrics or clothes was evaluated according to the following standards.

A: no deposition was observed.

B: Slight amount of the deposits was observed.

C: Deposition was observed.

EVALUATION OF PARTICLE STRENGTH

A sample of a granular detergent composition having a temperature of 50° to 60° C. was placed in a cell having a diameter of 5.0 cm and a height of 5.5 cm and, then, a 3 kg load was weighed on the top of the sample for 3 minutes. The particle strength was evaluated according to the settling % of the sample in the cell.

EVALUATION OF DETERGENCY

The organic soiling substances listed below were heated and mixed with each other at a temperature of 60° to 80° C. After allowing to cool to room temperature, the inorganic clay and carbon black listed below were added to the mixture and which was further mixed in a mortar. The weight ratio of the artificial organic soiling substances, clay and carbon black was 49.75:49.75:0.5

(i) Organic Soiling Substance

Myristic Acid

Oleic Acid

Tristearin

Triolein

Cholesterol

Cholesterol Stearate

Paraffin Wax

Squalene (ii) Inorganic Soiling Substance

Clay (After drying Shimosueyoshi-loam at 800° C. for 3 hours, the dried loam was ground to collect the powder particles which pass through a screen having a size of 325 meshes).

The mixed soiling substances were coated, little by little, to non-fluorescent clothes, which were previously desized, by using a sponge, so that the clothes were contaminated or soiled to such an extent that the reflectance (%) measured by an Elrepho Reflectometer(-manufactured by Carl Zeiss) was 42±2%. The soiled clothes were further rubbed with a clean sponge and, then, were treated at a temperature of 75° C. for 5 hours to strengthen the attachement of the soiling substances on the clothes. Thereafter, the soiled clothes were cut into samples each having a size of 5 cm×5 cm. Ten artificially soiled test samples thus obtained were washed in a Terg-O-Tometer (manufactured by U.S. Testing Co.) under the conditions of a detergent concentration of 0.133%, the hardness of water used of 3°DH, the bath volume of 900 ml, a bath temperature of 25° C. and a bath ratio of 30, at 120 r.p.m. for 10 minutes. Clothes having 0.6% by weight of the artificial organic soiling substances attached thereto were used to adjust the desired bath ratio. The rinsing was carried out for 3 minutes under the same conditions as in the washing, except that the detergent was not used.

The detergency (%) was determined according to the following calculation.

$$\text{Detergency (\%)} = \frac{Rw - Rs}{Ro - Rs} \times 100$$

wherein

Ro: the reflectance (%) of the clean clothes

Rs: the reflectance (%) of the soiled clothes before washing

Rw: the reflectance (%) of the soiled clothes after washing

The results are shown in Table 1 below as an index number when the detergency (%) of the standard detergent composition listed below was assumed to be 100.

| Standard Detergent Composition | % by weight |
|---|---|
| Sodium linear alkylbenzene sulfonate ($C_{12}$ alkyl) | 18 |
| Sodium tripolyphosphate | 25 |
| Sodium silicate ($Na_2O/SiO_2$ = 1/2.2) | 5 |
| Sodium carbonate | 3 |
| Carboxymethyl cellulose | 1 |
| Water | 5 |
| Sodium sulfate | balance |

As is clear from the results shown in Table 1 below, the zeolite-containing non phosphate granular detergent composition samples of the present invention (i.e. Sample Nos. 2, 3, 4, 8, 9, 12 and 13) had good particle strength, almost no deposits of zeolite on fabrics or clothes and good detergency.

TABLE 1

| Composition (% by weight) | Sample No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| AOS*1 | 0 | 5 | 10 | 13 | 20 | 10 | 10 | 5 | 12.5 | 16 | 16 | 15 | 6 | 0 |
| LAS*2 | 20 | 15 | 10 | 7 | 0 | 10 | 10 | 15 | 12.5 | 4 | 4 | 5 | 18 | 18 |
| Nonion Surfactant*3 | 0 | 0 | 0 | 0 | 0 | 0 | 0 | 0 | 0 | 0 | 0 | 0 | 0 | 6 |
| Sil*4 | 10 | 10 | 10 | 10 | 10 | 3 | 15 | 7 | 10 | 7 | 13 | 12 | 5 | 5 |
| Ash*5 | 10 | 10 | 10 | 10 | 10 | 17 | 5 | 13 | 10 | 13 | 10 | 8 | 15 | 5 |
| Zeolite (Anhydrous)*6 | 15 | 15 | 15 | 15 | 15 | 15 | 15 | 20 | 15 | 15 | 4 | 10 | 15 | 25 |
| PEG*7 | 2 | 2 | 2 | 2 | 2 | 2 | 2 | 2 | 2 | 2 | 2 | 2 | 2 | 2 |
| Sodium sulfate | balance | balance | balance | balance | balance | balance | balance | balance | balance | balance | balance | balance | balance | balance |
| Water | 5 | 5 | 5 | 5 | 5 | 5 | 5 | 5 | 5 | 5 | 5 | 5 | 5 | 5 |

TABLE 1-continued

| Composition (% by weight) | Sample No. 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| Particle Strength (Setting %) | 10 | 13 | 16 | 20 | 36 | 40 | 13 | 19 | 18 | 36 | 34 | 25 | 25 | 38 |
| Deposits of Zeolites on Fabrics or Clothes | A | A | A | A | A | A | C | A | A | A | A | A | A | B |
| Detergency | 94 | 98 | 100 | 102 | 103 | 100 | 100 | 100 | 103 | 102 | 96 | 101 | 100 | 102 |

*1: Sodium α-olefin sulfonates ($C_{14}$ to $C_{18}$)
*2: Sodium linear alkylbenzene sulfonates having a $C_{12}$ alkyl group
*3: Nonylphenol polyethoxylates (polymerization degree of ethylene oxide = 15)
*4: Sodium silicate ($Na_2O/SiO_2$ = 1/2.3)
*5: Sodium carbonate
*6: Type A zeolite particles having an average particle size of 1.3 microns (Silton B available from MIZUSAWA CHEMICAL CO.)
*7: Polyethylene glycol having an average molecular weight of 6000

We claim:

1. A zeolite-containing non phosphate granular detergent composition comprising:
   (a) at least one α-olefin sulfonate having 14 to 20 carbon atoms,
   (b) at least one linear alkylbenzene sulfonate having 10 to 14 carbon atoms in the alkyl group thereof,
   (c) at least one sodium silicate having the general formula of $Na_2O.nSiO_2$, wherein n is a number of from 2.0 to 2.6, and
   (d) at least one type A zeolite, the total amount of the components (a) and (b) being 20 to 25% by weight of the total amount of the composition, the amount of the component (d) being 10 to 20% by weight of the total amount of the composition and the weight ratio of the components (a), (b) and (c) being within the area enclosed by the points A [(a):(b):(c)=64:21:15], B [(a):(b):(c)=45:15:40], C [(a):(b):(c)=12:48:40] and D [(a):(b):(c)=17:68:15] defined in the accompanying triangular diagram.

2. A granular detergent composition as claimed in claim 1, wherein the weight ratio of the components (a), (b) and (c) is within the area enclosed by the points E [(a):(b):(c)=52:28:20], F [(a):(b):(c)=42:23:35], G [(a):(b):(c)=13:52:35] and H [(a):(b):(c)=16:64:20] defined in the accompanying triangular diagram.

3. A granular detergent composition as claimed in claim 1 or 2, wherein the particle size of the zeolite is 10 microns or less.

4. A granular detergent composition as claimed in claim 1 or 2, wherein the particle size of the zeolite is 5 microns or less.

* * * * *